United States Patent [19]

Hilfiker

[11] Patent Number: 4,929,125

[45] Date of Patent: May 29, 1990

[54] REINFORCED SOIL RETAINING WALL AND CONNECTOR THEREFOR

[76] Inventor: William K. Hilfiker, P.O. Drawer L, Eureka, Calif. 95501

[21] Appl. No.: 320,630

[22] Filed: Mar. 8, 1989

[51] Int. Cl.[5] ..... E02D 29/02

[52] U.S. Cl. ..... 405/262; 405/258; 405/286

[58] Field of Search ..... 405/262, 258, 259, 266, 405/267, 270, 274, 275, 284, 285, 286, 287; 403/209, 210, 211, 212, 213, 161

[56] References Cited

U.S. PATENT DOCUMENTS

| | | | |
|---|---|---|---|
| 3,111,060 | 11/1963 | Peeling | 87/13 |
| 4,125,970 | 11/1978 | Vidal | 52/31 |
| 4,154,554 | 5/1979 | Hilfiker | 405/273 |
| 4,324,508 | 4/1982 | Hilfiker et al. | 405/284 |
| 4,470,728 | 9/1984 | Broadbent | 405/284 |
| 4,514,113 | 4/1985 | Neumann | 405/286 |
| 4,728,227 | 3/1988 | Wilson | 405/284 |

*Primary Examiner*—Dennis L. Taylor
*Assistant Examiner*—J. Russell McBee
*Attorney, Agent, or Firm*—Limbach, Limbach & Sutton

[57] ABSTRACT

A reinforced soil embankment having precast concrete face panels with cantilevered sections extending into the embankment to support the panels in an upright condition and provide a surface beneath which a wedge may be inserted to plumb the panels during erection of the embankment. Soil reinforcing elements are secured to the panels intermediate their height to reinforce the embankment and secure the face panels in place. Connectors are provided for securing the reinforcing elements to the panels by means of loops formed on the elements for extension through eyes on the panels. The connectors also serve to orient the reinforcing elements in a horizontal disposition within the embankment.

9 Claims, 4 Drawing Sheets

REINFORCED SOIL RETAINING WALL AND CONNECTOR THEREFOR

BACKGROUND OF THE INVENTION

The present invention relates to a reinforced soil retaining wall for earthen formations and, more particularly, is directed to such a wall having concrete face panels and attached soil reinforcing elements. In its more specific aspects, the invention is concerned with an improved face panel having a cantilevered base portion which assists in retaining it in place and provides for plumbing of the panel during initial placement. The invention is also concerned with an improved connector for securing soil reinforcing elements to the face panels.

In the prior art it is well known to provide retaining walls for earthen embankments by reinforcing the soil of the embankments with elongated reinforcing elements. The reinforcing elements may take any number of forms, such as: welded wire mats, polymer geogrids, metal straps, or rods provided with lateral extensions. Although such walls make the earthen formation essentially self-sustaining, they are also often provided with face panels which serve both a decorative architectural function and to prevent erosion at the face of the embankment. The panels are generally secured to at least certain of the reinforcing elements. The most common means of securing has taken the form of loops formed on the elements which are in some way fastened to the panels, as for example by means of pins or bolts. Since the panels of such walls do not carry a significant load, they are generally relatively thin and simply stacked upon one another. In some cases, they have been provided with enlarged bases which serve to assist in stacking and to maintain the panels in an upright condition.

SUMMARY OF THE INVENTION

The concrete face panel of the invention comprises a vertically extensive planar body section with top and bottom edges so formed that the top edge of one panel is mutually engagable with the bottom edge of a like panel stacked thereabove. A cantilever section is fixed to and extends laterally from one side of the body section adjacent the bottom edge for extension into a soil embankment being reinforced. A soil reinforcing element is secured to the side of the planar body section from which the cantilever section extends at a level intermediate the top and bottom edges of the face section.

In constructing a reinforced soil embankment, the panels are stacked in tiers at the face of the embankment with the cantilever sections extending toward the embankment. Soil is backfilled behind each successive tier of panels and over the cantilever sections thereof to the level of the soil reinforcing elements. The soil reinforcing elements are then extended from the panels and over the backfill, and then the backfilling is continued to the level of the top of the panels in the tier. The next successive tier of panels is then stacked and plumbed by inserting wedges beneath the cantilevered sections of its panels and the backfill soil therebeneath. The steps of backfilling and extending the soil reinforcing elements are repeated for each successive tier until the embankment reaches the desired height.

The resulting embankment comprises a plurality of tiers of face panels, each of which has the cantilevered sections and reinforcing elements of the panels therein extending into the earthen formation. The soil reinforcing elements may be secured to the panels either by being cast in place therein during manufacture, or by being attached to the panels at the situs of the embankment. For the latter purpose, mutually engagable connecting elements are provided on the panels and the elements.

The connecting elements on the panels comprise horizontally disposed anchor eyes fixed to and extending laterally from the panels. The connectors on the soil reinforcing elements comprise vertically disposed loops extensible through the eyes. Once extended through the eyes, rods may be extended through the loops to secure the eyes and loops against separation.

A principal object of the invention is to provide an improved soil reinforced embankment and method of constructing the same wherein precast panels at the face of the embankment have cantilevered sections which serve to both plumb the panels during erection of the embankment and secure the panels in place within the embankment.

Another object of the invention is to provide such an embankment wherein soil reinforcing elements are secured intermediate the height of the face panels and extended into the embankment during the course of its construction to both secure the panels in place and reinforce the soil within the embankment.

Another object of the invention is to provide an improved connector for securing soil reinforcing elements to face panels wherein connection is provided by simple loops on the elements which are received within eyes extending from the panels.

Still another object related to the latter object is to provide such a connector which serves to orient the soil reinforcing elements in a horizontal disposition and which may also be used to secure plural soil reinforcing elements to one another.

Yet another object of the invention is to provide a face panel component for use in constructing a soil reinforced embankment which includes a polymer geogrid secured in embedded condition within the panel.

Still another object related to the latter object is to provide such a component wherein a cantilever section extends from the panel and the geogrid may be rolled into a cylinder and temporarily stored on the cantilever section.

Yet another object is to provide such a component wherein the face panel is precast concrete and the geogrid is secured in place by being attached to steel reinforcing rods within the concrete.

These and other objects will become more apparent when viewed in light of the following detailed description and accompanying drawings.

DESCRIPTION OF THE PREFERRED EMBODIMENTS

Figure 1:
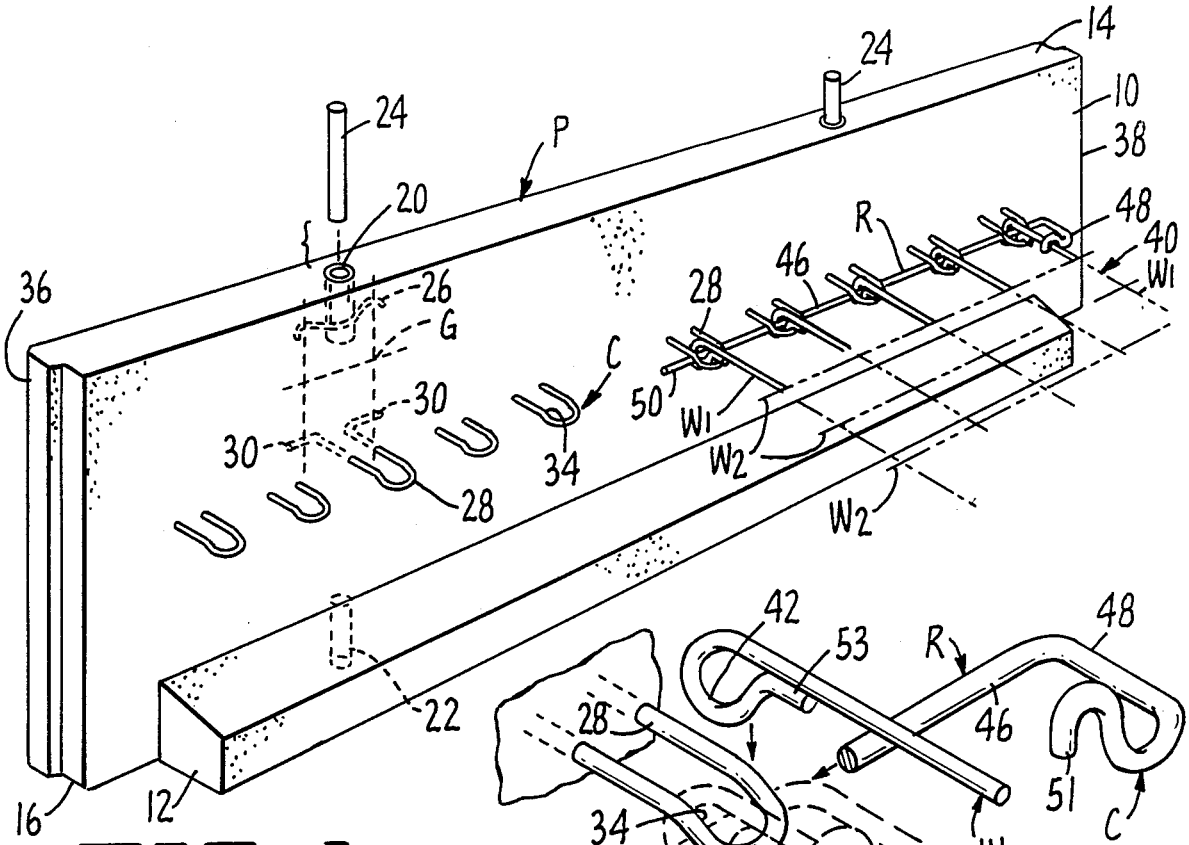
FIG. 1 is a perspective view of a first embodiment panel and the connectors therefor, with one alignment pin shown in exploded perspective.

Referring to FIG. 1, the first embodiment face panel is designated in its entirety by the letter "P". The panel is formed of reinforced concrete and comprises a planar body section 10 and an integrally formed cantilever section 12. The planar body section 10 has flat top and bottom edge surfaces 14 and 16, respectively. As will become more apparent from the subsequent discussion, the top edge 14 is mutually engagable with the bottom edge of a like panel stacked thereabove. Cylindrical sockets 20 and 22, respectively, are formed in the surfaces 14 and 16 for the receipt of alignment pins 24. The sockets 20 and 22 are vertically aligned and, when the panels are stacked, the pins are received in the sockets to maintain the stacked panels in alignment. As shown in phantom in FIG. 1, the panel "P" is reinforced by an internal gridwork "G" of reinforcing steel. During casting of the panel, the sockets 20 and 22 are formed by plastic sleeves secured to the gridwork by wire hangers 26.

The panel "P" also includes connectors "C" cast in place within the face section 10. The connectors are disposed in horizontal alignment and each comprise a generally U-shaped wire segment 28 having legs which extend into the face panel and lateral extensions 30 which extend to the front side of the gridwork (as viewed in FIG. 1). To minimize the likelihood of galvanic corrosion within the concrete of the panel, the wire segments 28 preferably are spaced from the gridwork "G". The wire segment 28, together with the inner surface of the panel 10, defines an eye 34 having a distal end segment 35. The distal end segment 35 extends downwardly at approximately 25° to 30° from horizontal.

The ends of the panel "P" are designated by the numerals 36 and 38. In the preferred embodiment illustrated, these ends are of a tongue and groove configuration so that when arranged in horizontally aligned tiers the ends of adjacent panels will mate. From FIG. 1, it will be seen that the ends of the cantilever section 12 are spaced inwardly from the panel ends 36 and 38. This spacing is provided so that a filter fabric may be extended over the mating ends of the panels to the inside of the body sections 10.

In a typical embodiment, the panel "P" would have the following proportions:

| | |
|---|---|
| Length | 12½ feet |
| Height | 2½ feet |
| Thickness of body section 10 | 5 inches |
| Depth of cantilever section (measured from back of body section) | 6 inches |
| Distance between ends of body section 10 and ends of cantilever section 12 | 8 inches |
| Distance between bottom of section 10 and level of connectors "C" | 15 inches |

From this example, it will be seen that the ratio of the distance between the bottom of the panel and the level of the connectors "C", to the depth of the cantilever section 12, is 15:6. This ratio is chosen so that the cantilever section will hold the panel against tilting during the backfilling operation until such time as soil reinforcements are secured to the connectors "C" and anchored within the backfill.

The soil reinforcing elements depicted in FIG. 1 take the form of welded wire gridworks 40. Each gridwork comprises spaced generally parallel longitudinally extending wires "$W_1$" and spaced generally parallel transversely extending wires "$W_2$". The wires "$W_1$" and "$W_2$" are welded together at their intersections. The ends of the wires "$W_1$" adjacent the panel "P" are formed with extensions in the form of vertically disposed loops 42 extending downwardly from and generally normal to the body of the wire "$W_1$" and proportioned for receipt in the eyes 34 of the connectors "C".

From FIG. 1, it will be appreciated that the connectors "C" are spaced and positioned so as to align with the longitudinal wires "$W_1$" of the gridworks 40. In use, a gridwork is secured to a panel by extending the loops 42 thereof through the connectors "C" of the panel (see FIG. 2) to pass the loops through the eyes 34 from one side of the connectors to the other (see FIG. 3). A retaining rod "R" is then extended through the loops 42 to the bottom side of the connectors "C" (see FIG. 4), thus securing the gridwork against separation from the connectors. Due to the downward inclination of the distal end segments 35 of the eyes, tension applied to the wires "$W_1$" functions to draw the rod "R" against the segments.

The retaining rod "R" has an elongate body section 46 with an L-shaped handle 4s at one end and a smooth head 50 at the other end. The head B0 is proportioned to slide through the loops 42 to guide the rod into place. A hook section 51 is formed on the distal end of the handle 48. After the rod "R" is passed fully through the loops, the handle 48 is turned to engage the hook section over one of the wires "$W_1$", thus securing the rod against displacement from the loops.

From the above described description of the structure and mode of operation of the connector "C" , it will be appreciated that the connectors provide for the securing of soil reinforcing elements to the panels with a minimum of modification of the structure of the elements. In the FIG. 1 embodiment, the modification involves forming the downwardly extending loops 42 on the wires "$W_1$", with the distal ends 53 of the wire forming the loops folded against the underside of the wires "$W_1$". No weld between the ends 53 and the wires "$W_1$" is required. When the wires "$W_1$" are subjected to tension, the ends 53 frictionally bind between the eyes 34 and the wires "$W_1$" to prevent the loops straightening out. This frictional binding is aided by the drawing of the rod "R" against the inclined segments 35 of eyes as the result of such tension.

Figure 4:
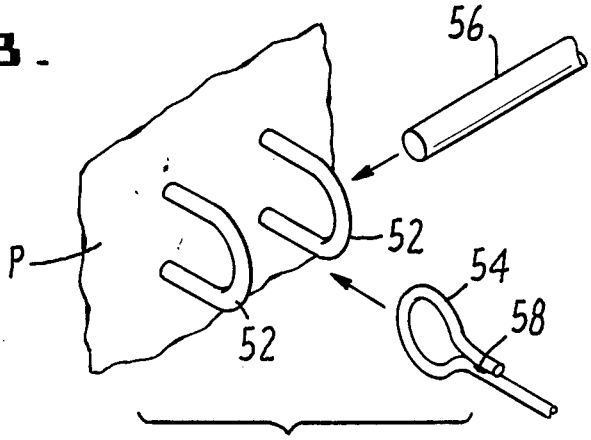
FIG. 4. (PRIOR ART)
FIG. 4 is an exploded perspective view showing a prior art connection.
Figure 5:
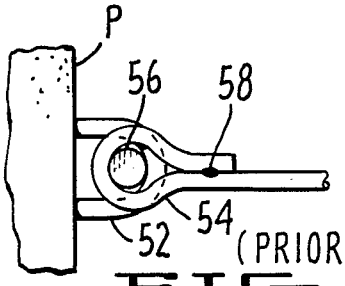
(PRIOR ART) FIG. 5
FIG. 5 is a side elevational view showing the prior art connector of FIG. 4 in condition securing an element to a panel.
Figure 7:
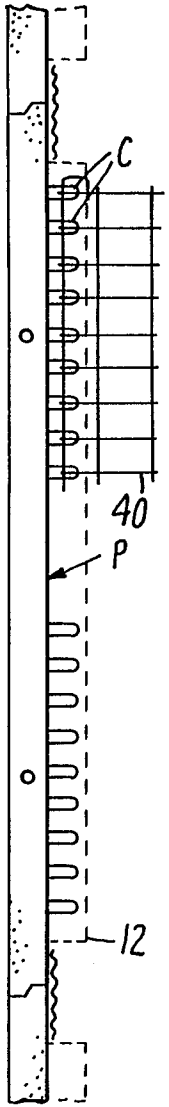
FIG. 7 is a cross-sectional view taken on the plane designated by line 7—7 of FIG. 6.

FIG. 4 and 5 show a prior art arrangement for securing soil reinforcements to panels. In this arrangement, each connection requires a pair of vertically disposed loops 52 secured to and extending from the panel and a closed loop 54 formed on the end of the soil reinforcing element. In use, the loop 54 is first positioned between a pair of loops 52 and a rod 56 is then extended through the aligned loops to secure the loop 54 to the loops 52. A spot weld 58 secures the distal end of the loop to wire from which it extends to hold the loop against opening. The connection is dependent on the integrity of this weld.

Figure 6:
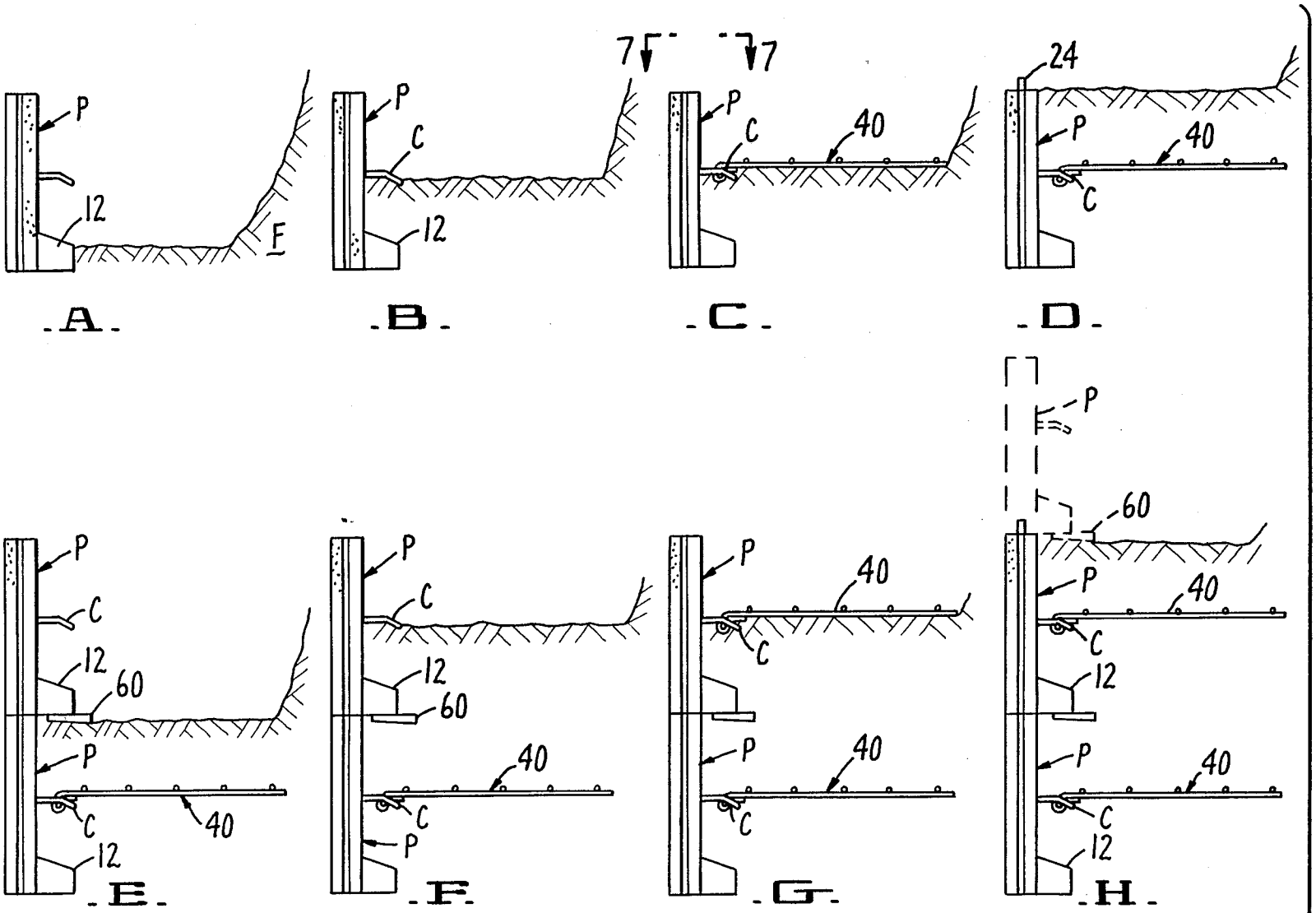
FIG. 6 is a cross-sectional side elevational view showing the steps of constructing a soil reinforced embankment through use of the inventive method.

FIG. 6 depicts the steps used to construct a reinforced soil embankment from panels and soil reinforcing gridworks of the type illustrated in FIG. 1. In step A a first tier of panels "P" is placed at the foot of the earthen formation "F" where the embankment is being constructed. Step B shows backfill soil placed behind the first tier of panels "P" and over the cantilever sections 12 thereof to the level of the connectors "C". Step C shows the welded wire soil reinforcing gridworks 40 secured to the connectors "C" and extended over the backfill soil. Step D shows the backfill continued to the level of the upper edge of the panels "P" and the alignment pins 24 placed in the sockets in the top edge surfaces of the first tier of panels. Step E shows a second tier of panels "P" stacked above the first tier with the bottom surfaces of the second tier panels resting on the top surfaces of the panels in the first tier and the alignment pins 24 engaged in the opposed sockets of the stacked panels. As shown in step E, wedges 60 have been inserted between the cantilever sections 12 of the second tier of panels and the backfill soil therebeneath to plumb the second tier of panels relative to the first tier. Step F shows backfill placed behind the second tier of panels and over the cantilever sections 12 thereof to the level of the connectors "C". Step G shows welded wire gridworks 40 secured to the connectors "C" of the second tier and placed over the backfill therebeneath. Step H shows backfill placed over the gridworks 40 extending from the second tier of panels and, in phantom, the placement of a third tier of panels over the second tier.

The embankment is erected to the desired height by placing successive tiers of panels and the reinforcing gridworks and backfill therefor through steps corresponding to steps E through H for each successive tier. The resulting embankment is comprised of soil reinforced by the gridworks 40, with panels "P" at the face thereof. The panels are held in place both by the cantilever sections 12 and the gridworks 40. During erection of the embankment, the cantilever sections 12 of each tier of panels "P" serve to secure the panels in vertical orientation as backfill is placed and compacted to the level of the connectors "C" extending from the panels. Once the gridworks 40 are extended from the panels and backfill is placed thereover, the primary force retaining the panels in vertical orientation is provided by the gridworks.

Figure 8:
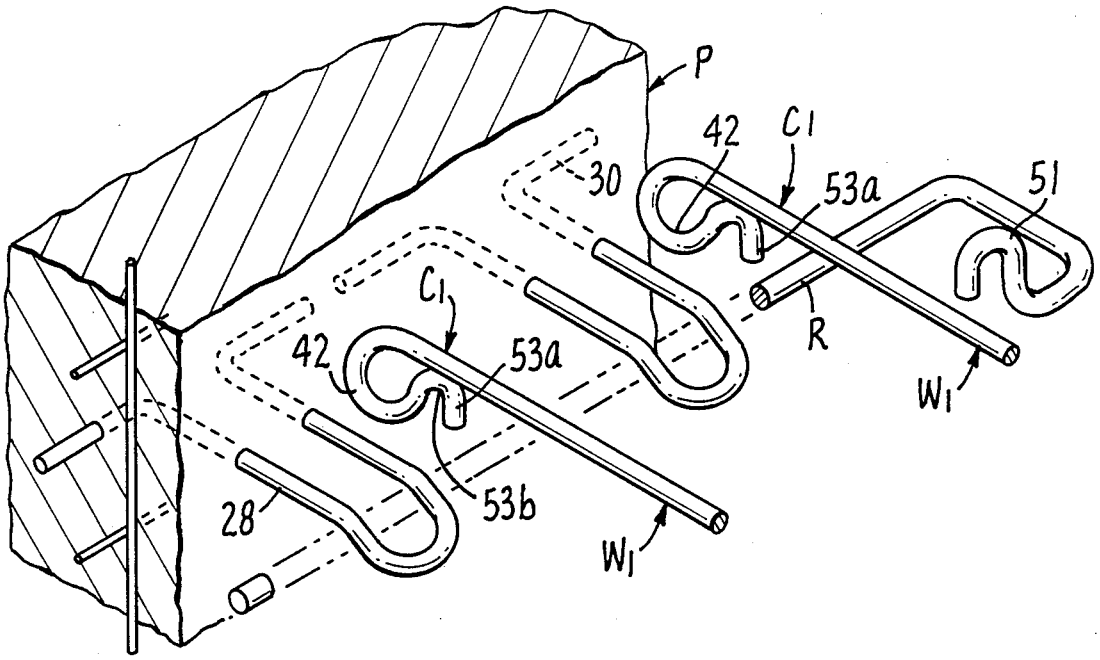
FIG. 8 is an exploded perspective view, with parts thereof broken away, showing an alternative construction of the connector for use in securing a soil reinforcing mat to a face panel.
Figure 9:
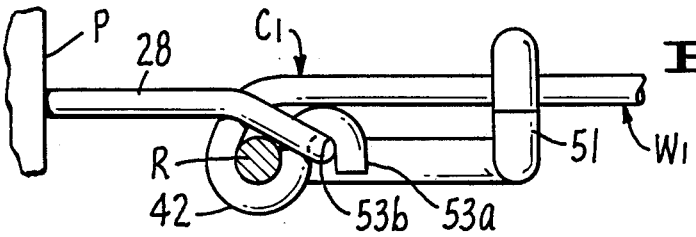
FIG. 9 is a side elevational view of the connector of FIG. 8, showing the mat secured in place.

FIGS. 8 and 9 show a modified connector "$C_1$". This connector differs from that of FIGS. 1 to 3 only in that the distal end designated **53*a*, of the wire "$W_1$", forming the loop 42 is bent downwardly to form a hook 53*b* proportioned for engagement over the wire segment forming the eye 34. The hook 53*b* functions to further secure the loop 42 against movement relative to the eye 34. Other than this difference, the connector "$C_1$" functions and is used in the same way as the "C". The retaining rod "R" functions in the FIGS. 8 and 9 embodiment in the same manner in which it functioned in the FIGS. 1 to 3** embodiment.

Figure 2:
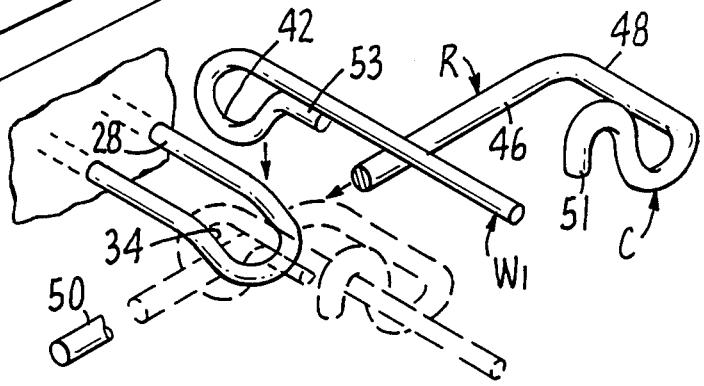
FIG. 2 is an exploded perspective view showing one of the connectors of the first embodiment panel in exploded condition.
Figure 3:
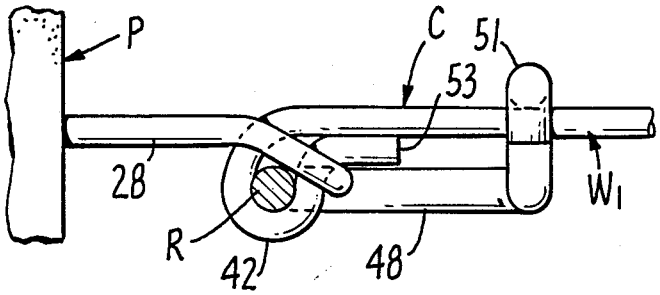
FIG. 3 is a side elevational view showing one of the connectors of the first embodiment panel in condition securing a reinforcing element to the panel.
Figure 10:
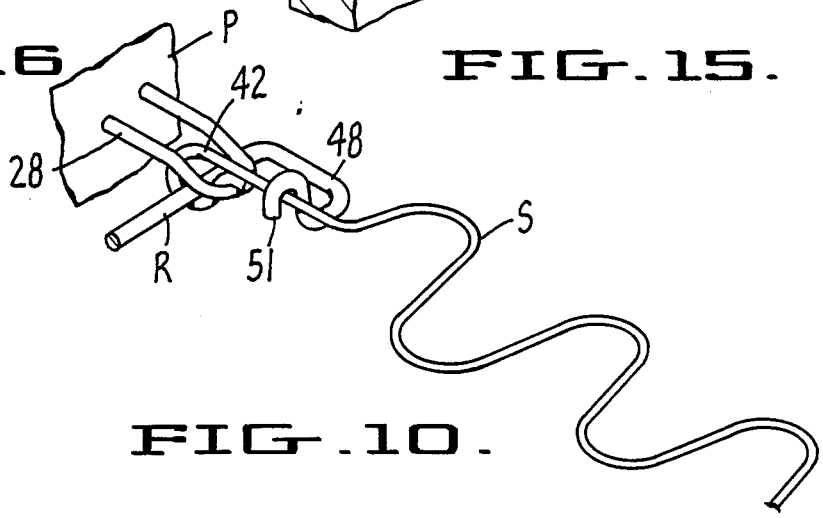
FIG. 10 is a perspective view showing how the connector of the first embodiment panel could be used to secure the panel to swiggle-like soil reinforcements of the type shown in co-pending application Serial No. 118,317, filed Nov. 6, 1987.

FIG. 10 illustrates a connector "C" identical to that of FIGS. 1 to 3 in use in securing a swiggle soil reinforcement "S" to a panel "P". From this figure, it will be seen that the connector "C" and the loop 42 formed on the end of the soil reinforcement "S" serve both to secure the reinforcement to the panel and to horizontally orientate the swiggles of the soil reinforcement.

Figure 11:
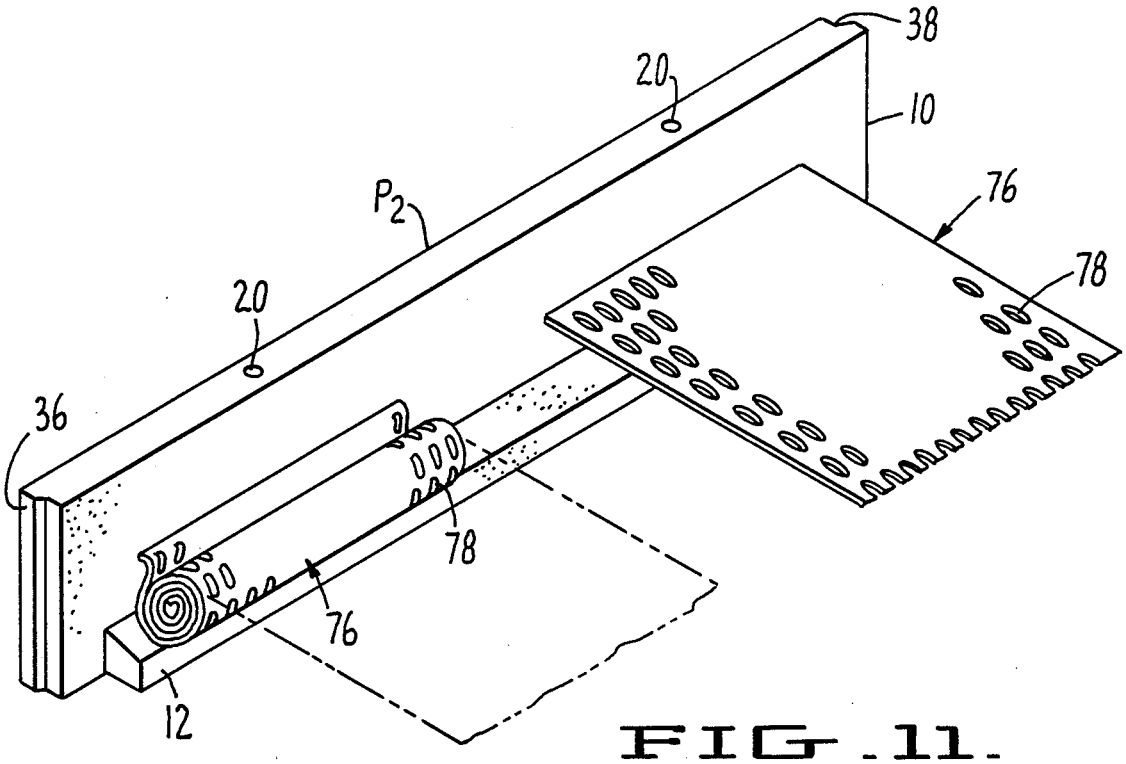
FIG. 11 is a perspective view of a second embodiment of the face panel of the invention wherein the soil reinforcing elements take the form of polymer geogrids having one end thereof cast in place within the panel.
Figure 12:
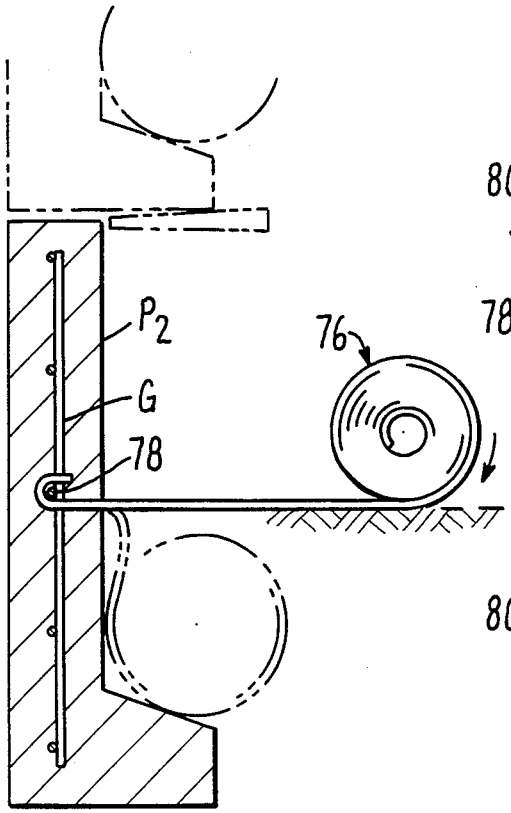
FIG. 12 is a cross-sectional elevational view illustrating the panel of FIG. 11 in the process of being used to construct a soil reinforced embankment, with phantom lines showing a like panel stacked thereabove.
Figure 13:
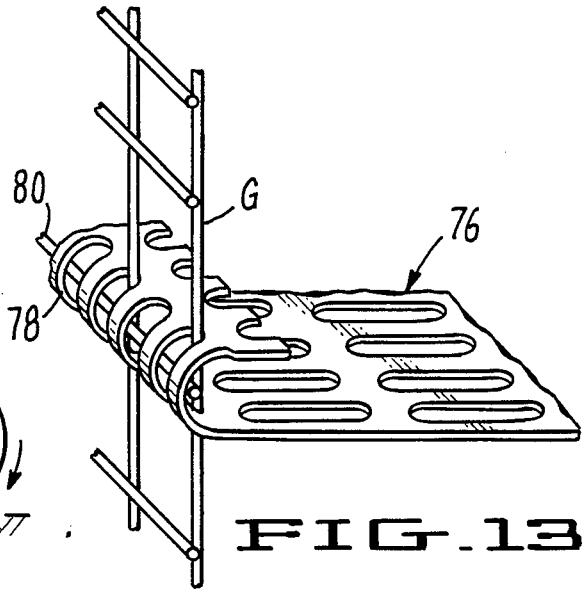
FIG. 13 is a perspective view illustrating how the geogrids of the second embodiment face panel are secured to the reinforcing steel within the face panel.

The second embodiment face panel illustrated in FIGS. 11 to 13 is designated "$P_2$". This panel differs from the first embodiment panel "P" only in the manner in which the soil reinforcements are secured thereto. In the case of the panel "$P_2$", the soil reinforcements take the form of polymer geogrids 76 having aligned rows of slots 78 extending therethrough. The geogrids are cast in place within the planar body sections of the panel and connected to reinforcing steel therein as shown in FIG. 13. There it can be seen that the ends of the geogrids are bent upon themselves so as to extend the slots therein around the vertical wires of the reinforcing steel gridwork "G". A rod 80 is extended through the bent over ends of the geogrids to one side of the vertical wires of the gridwork "G" to secure the wires and geogrids together. The geogrids 76 and the gridwork "G" are so assembled prior to formation of the concrete body of the face panel. Once the body of the panel is formed, the geogrid is locked in place relative to the panel.

Figure 14:
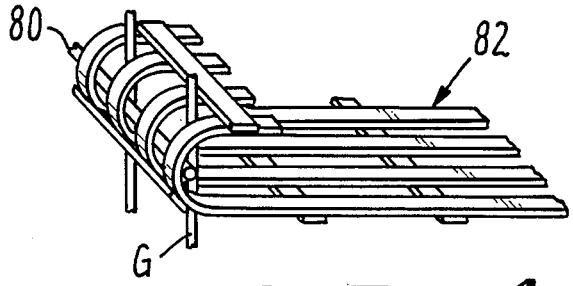
FIG. 14 is a perspective view illustrating how an alternative form of plastic geogrid mat could be secured to the reinforcing steel within the second embodiment face panel.

FIG. 14 shows an alternative geogrid 82 which may be used in place of the geogrid 76. The geogrid 82 functions in a manner identical to that of the geogrid 76 and is similarly secured to the reinforcing steel gridwork "G". The geogrid 82 differs from the geogrid 76 primarily in that it is made up of intersecting bands that are welded together, whereas the geogrid 76 is a monolithic structure. In the case of the geogrid 82, the slots therein are formed between adjacent transverse bands.

The elements of the panel "$P_2$" corresponding to those of the panel "P" are designated by like numerals. During transport and storage of the panels, the geogrids 76 are rolled up and stored in place on top of the cantilever section 12 (see FIG. 20).

The panels "$P_2$" are used in the construction of earthen embankments in essentially the same manner as the panels "$P_1$". The steps employed correspond to steps A through H of FIG. 6. FIG. 20 shows the one relatively minor difference, namely that the geogrid soil reinforcements are placed above the fill therebeneath by rolling the geogrids over the fill.

Figure 16:
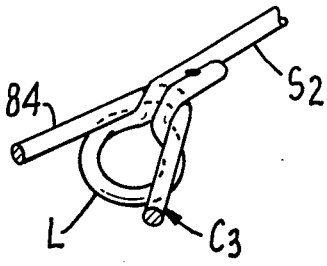
Figure 15:
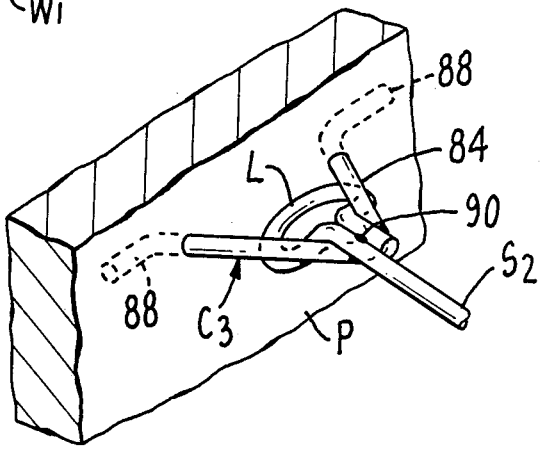
FIG. 15 is a perspective view, with parts thereof broken away, showing another alternative embodiment connector for use in securing a metallic soil reinforcing element to a face panel; and, FIG. 16 is a perspective view of the looped end of the soil reinforcing wire of the FIG. 15 connector.

FIGS. 15 and 16 show a modified connector for securing metallic soil reinforcing elements to the face panels "P". This connector, designated "$C_3$" may be used for securing metallic soil reinforcing elements of either the gridwork type 40 or the swiggle type "S". The connector "$C_3$" takes the form of a wire 84 projecting horizontally from the panel "P" to define a V-shaped eye, with laterally extending legs 88 cast in place within the panel. The soil reinforcing element shown in FIG. 15 is designated "$S_2$" and is formed with a bent down loop "L" proportioned for extension through the V-shaped wire 84. When received within the V-shaped wire and subjected to pull back tension (tension to the right as viewed in FIG. 15), the loop "L" locks within the converging end of the V-shaped wire 84, thus securing the soil reinforcement "$S_2$" from separation from the panel "P".

The loop "L" is rigid with the reinforcement "$S_2$" and extends downwardly from the longitudinal axis of the reinforcement at an angle of approximately 60°. In the preferred embodiment, the loop "L" is formed by bending the distal portion of the soil reinforcement "$S_2$" into a loop, with a spot weld 90 securing the loop against spreading. The connector "$C_3$" has the advantage that it does not require a retaining rod, such as the rod "R" and that it also may serve to horizontally orient the soil reinforcement "$S_2$" within an earthen formation.

Conclusion

While preferred embodiments have been illustrated and described, it should be understood that the invention is not intended to be limited to the specifics of these embodiments, but rather is defined by the accompanying claims.

I claim:

1. A method of erecting a reinforced soil embankment, said method comprising:
   (a) providing a plurality of stackable face panels each having:
      (1) a vertically extensive planar body section with top and bottom edges, the top edge of each of said sections being mutually engagable with the bottom edge of a panel stacked thereabove;
      (2) a cantilever section fixed to and extending longitudinally of and laterally from one side of the body section adjacent the bottom edge thereof; and,
      (3) a soil reinforcing element secured to the side of the planar body section from which the cantilever section extends at a level intermediate the top and bottom edges of the body section;
   (b) disposing a first tier of said panels at the bottom of the embankment being erected with the cantilever sections extending toward the embankment;
   (c) backfilling soil behind said first tier of panels and over the cantilever sections thereof to the level of the soil reinforcing elements secured to the panels in the first tier;
   (d) extending the soil reinforcing elements from the panels in the first tier toward the embankment;
   (e) backfilling soil behind said first tier of panels and over the soil reinforcing elements to the level of the top edge of said panels;
   (f) disposing a second tier of said panels in stacked relationship to the first tier with the cantilever sections of the panels in said second tier extending over the backfill therebelow and toward the embankment;
   (g) inserting wedges between cantilever sections of the panels of the second tier and the backfill therebeneath to plumb the panels of the second tier with those of the first tier;
   (h) backfilling soil behind said second tier of panels and over the cantilever sections thereof to the level of the soil reinforcements extending from the panels of said second tier;
   (i) extending the soil reinforcing elements secured to the panels in the second tier toward the embankment; and,
   (j) backfilling soil behind said second tier of panels and over the soil reinforcing elements extending therefrom.

2. A reinforced soil embankment comprising:
   (a) a first tier of face panels at the foot of the embankment wherein each panel has:
      (1) a vertically extensive planar body section with top and bottom edges, the top edge of each of said sections being mutually engagable with the bottom edge of a panel stacked thereabove;
      (2) a cantilever section fixed to and extending longitudinally of and laterally from one side of the body section adjacent the bottom edge thereof and toward the embankment; and,
      (3) connector means intermediate the height of the body section for securing a soil reinforcing element to the panel;
   (b) a second tier of panels of a construction corresponding to that of the first tier, the panels of the second tier being in stacked relationship to those of the first tier with the cantilever sections of the panels in said second tier extending toward the embankment;
   (c) soil reinforcing elements secured to the connector means of the panels in the first and second tiers and extending toward the embankment;
   (d) backfill soil disposed behind said first and second tiers of panels and over the cantilever sections thereof and the soil reinforcing elements secured thereto; and,
   (e) wedges between cantilever sections of the panels of the second tier and the backfill therebeneath to plumb the panels of the second tier with those of the first tier prior to the placement of backfill behind the panels of the second tier.

3. An embankment according to claim 2 wherein the connector means comprise horizontally disposed eyes extending from the sides of the body sections from which the cantilever sections extend and the soil reinforcing elements are secured to the connector means by:
   (a) vertically extending loops formed on the elements and extending through the eyes from one side thereof to the other; and,
   (b) rods extending through the loops for engagement with said other sides of the eyes to prevent removal of the loops from the eyes.

4. An embankment according to claim 3 wherein:
   (a) the eyes are formed of wire of a generally circular cross-section; and, (b) the loops have formed adjacent thereto hook sections engageable with the wire forming the eyes to limit movement of the loops relative to the eyes.

5. A reinforced soil embankment comprising:

(a) a first tier of face panels at the foot of the embankment wherein each panel has:

(1) a vertically extensive planar body section with top and bottom edges, the top edge of each of said sections being mutually engagable with the bottom edge of a panel stacked thereabove;

(2) a cantilever section fixed to and extending longitudinally of and laterally from one side of the body section adjacent the bottom edge thereof and toward the embankment; and, (3) a soil reinforcing element secured to the side of the planar body section from which the cantilever section extends and toward the embankment at a level intermediate the top and bottom edges of the body section;

(b) a second tier of panels of a construction corresponding to that of the first tier, the panels of the second tier being in stacked relationship to those of the first tier with the cantilever sections and the soil reinforcing elements of the panels of said second tier extending toward the embankment;

(c) backfill soil disposed behind said first and second tiers of panels and over the cantilever sections thereof and the soil reinforcing elements extending therefrom; and, (d) wedges between cantilever sections of the panels of the second tier and the backfill therebeneath to plumb the panels of the second tier with those of the first tier prior to the placement of backfill behind the panels of the second tier.

6. An embankment according to claim 5 wherein:

(a) the face panels are of precast concrete construction having steel reinforcing rods embedded in the planar body sections thereof; and, (b) the soil reinforcing element comprises a polymer geogrid having an end embedded in the planar body section and extending around at least certain of the reinforcing rods therein.

7. An embankment according to claim 6 wherein:

(a) the geogrid has elongated openings formed therein and is folded at one end to extend said openings around said certain rods; and, (b) the geogrid is secured to said certain rods by a retaining rod extended through the folded end of the geogrid to one side of the rods.

8. An improved precast concrete face panel for reinforced soil embankments, said panel comprising:

(a) a vertically extensive planar body section with steel reinforcing rods embedded therein, said section having top and bottom edges so formed that the top edge of one of said sections is mutually engagable with the bottom edge of a like panel stacked thereabove;

(b) a cantilever section fixed to and extending longitudinally of and laterally from one side of the body section adjacent the bottom edge thereof for extension into a soil embankment being reinforced;

(c) a soil reinforcing polymer geogrid having;

(1) closed sided slots formed therein;

(2) a folded over end embedded in the planar body section to extend certain of the slots around reinforcing rods embedded within the face section; and, (3) an extended end extending from the folded over end and the side of the planar body section from which the cantilever section extends at a level intermediate the top and bottom edges of the body section;

(d) a retaining rod embedded within the body section and extending through the folded over end of the geogrid to one side of the reinforcing rods about which the slots within the geogrid extend to secure the geogrid against separation from said reinforcing rods.

9. A face panel according to claim 8 wherein the extended end of the geogrid is elongated and rolled upon itself to fit compactly against the face section and may be unrolled for extension into an embankment to be reinforced.

* * * * *